US012768249B1

(12) United States Patent
Ciufu et al.

(10) Patent No.: US 12,768,249 B1
(45) Date of Patent: Oct. 20, 2026

(54) TUBING-CASING ANNULUS CLEANOUT SYSTEM

(71) Applicant: SAUDI ARABIAN OIL COMPANY, Dhahran (SA)

(72) Inventors: Alexandru Cosmin Ciufu, Dhahran (SA); Sajid Mehmood, Dhahran (SA); Mohammed A. Kaki, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/246,063

(22) Filed: Jun. 23, 2025

(51) Int. Cl.

| | |
|---|---|
| ***E21B 37/00*** | (2006.01) |
| ***E21B 19/22*** | (2006.01) |
| ***E21B 19/24*** | (2006.01) |
| ***E21B 33/068*** | (2006.01) |

(52) U.S. Cl.
CPC ..... *E21B 37/00* (2013.01); *E21B 19/22* (2013.01); *E21B 19/24* (2013.01); *E21B 33/068* (2013.01)

(58) Field of Classification Search
CPC ..... E21B 19/22; E21B 19/24; E21B 21/00; E21B 33/068; E21B 37/00; E21B 37/06
See application file for complete search history.

(56) References Cited

U.S. PATENT DOCUMENTS 5,458,198 A * 10/1995 Hashemi ..... E21B 37/00 166/384
5,927,405 A * 7/1999 Monjure ..... E21B 33/14 166/77.2
6,186,239 B1 * 2/2001 Monjure ..... E21B 33/10 166/97.1
6,289,992 B1 * 9/2001 Monjure ..... E21B 23/08 166/77.2
6,497,290 B1 12/2002 Misselbrook et al.
7,686,091 B2 * 3/2010 Jennings ..... E21B 33/068 226/173
7,878,247 B2 2/2011 Misselbrook et al.
8,181,700 B2 * 5/2012 Baugh ..... E21B 33/068 166/97.5
8,230,934 B2 * 7/2012 Darby ..... E21B 33/072 166/85.1

(Continued)

FOREIGN PATENT DOCUMENTS

CN 113622873 A * 11/2021 ..... E21B 41/00
NO 315130 B1 * 7/2003 ..... E21B 33/068
WO WO-2024229316 A1 * 11/2024 ..... E21B 47/10

*Primary Examiner* — Jennifer H Gay
(74) *Attorney, Agent, or Firm* — Vorys, Sater, Seymour and Pease LLP

(57) ABSTRACT

A system for performing cleanout operations in a tubing-casing annulus (TCA) of a wellbore includes a wellhead configured with a primary annulus valve operable to provide access to the TCA, a mini-coil tubing string constructed of flexible material and arranged to discharge injection fluids into the TCA, and a pumping unit adapted for delivering the injection fluids into the system. The system further comprises a guidance system including a guide arch extending into primary annulus valve the such that the mini-coil tubing string may transition into the TCA without interrupting production through the tubing string. Additionally, the system includes stuffing boxes arranged for maintaining well control and a flowback assembly configured to manage fluid returns.

20 Claims, 2 Drawing Sheets

(56) References Cited

U.S. PATENT DOCUMENTS

| | | | | |
|---|---|---|---|---|
| 8,327,934 | B2 * | 12/2012 | Jennings | E21B 33/068 166/64 |
| 8,528,651 | B2 * | 9/2013 | Darby | E21B 36/00 166/385 |
| 9,045,954 | B2 * | 6/2015 | Langeteig | E21B 19/22 |
| 9,782,813 | B2 * | 10/2017 | Sorensen | E21B 19/22 |
| 11,060,011 | B2 * | 7/2021 | Singh | E21B 37/00 |
| 11,306,553 | B2 * | 4/2022 | Sorensen | E21B 23/08 |
| 11,872,607 | B2 * | 1/2024 | Mackenzie | E21B 7/18 |
| 12,116,857 | B2 * | 10/2024 | Soma | E21B 33/068 |
| 2010/0018721 | A1 * | 1/2010 | Jennings | E21B 33/068 166/385 |
| 2010/0314097 | A1 * | 12/2010 | Jennings | E21B 47/04 166/65.1 |
| 2010/0319933 | A1 * | 12/2010 | Baugh | E21B 33/068 166/381 |
| 2011/0017463 | A1 | 1/2011 | El Azm | |
| 2012/0241174 | A1 * | 9/2012 | Langeteig | E21B 33/068 166/77.2 |
| 2014/0053874 | A1 * | 2/2014 | Mackenzie | E21B 37/00 134/22.12 |
| 2015/0290691 | A1 * | 10/2015 | Sorensen | B21D 7/085 72/161 |
| 2019/0169485 | A1 * | 6/2019 | Singh | E21B 37/00 |
| 2021/0213490 | A1 * | 7/2021 | Mackenzie | B08B 9/0325 |
| 2021/0238967 | A1 * | 8/2021 | Shaw | E21B 43/122 |
| 2022/0251917 | A1 | 8/2022 | Barnes et al. | |
| 2024/0418062 | A1 * | 12/2024 | Dubost | E21B 43/12 |

* cited by examiner

TUBING-CASING ANNULUS CLEANOUT SYSTEM

FIELD OF THE DISCLOSURE

The present disclosure relates generally to operations conducted in a subterranean wellbore, and more particularly to operations that include pumping fluids into an annulus defined between a tubing string and a casing string in the wellbore.

BACKGROUND OF THE DISCLOSURE

Wellbores may be drilled to recover natural deposits of oil and gas, as well as other desirable materials that are trapped in subterranean geological formations. Once drilling is complete, the wellbore may be completed to ensure the safe and efficient extraction of oil and gas. For example, one or more steel casing strings may be lowered into the wellbore and cemented into place to thereby support the wellbore wall and prevent collapse of the wellbore. A production tubing string may then be installed through the one or more casing strings. Production tubing is a smaller diameter pipe placed within the casing to serve as a conduit for extracting the oil and gas from the subterranean reservoir to a surface location. The smaller diameter compared to the casing helps pull fluid to the surface more efficiently. Often, an elastomeric packer is installed in the tubing-casing annulus (TCA), e.g., the radial space between the tubing string and the casing string, to create a seal and prevent movement between the two strings.

During oil and gas production, the fluids in the TCA can mix with unwanted substances, such as sand, debris, or chemicals from the reservoir. This contamination can reduce the efficiency of the wellbore and interfere with the operation of the wellbore. Additionally, the packer may sustain damage over time. Unloading and replacing the contaminated fluid in the TCA with an uncontaminated fluid and repairing or replacing the packer may require a costly workover operation. The workover operation may sometimes require temporarily suspending production from the wellbore, which can increase the costs associated with the cleanout and repair operations.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system for performing cleanout operations in a wellbore may include a wellhead positioned at surface location over the wellbore and include a primary annulus valve for providing selective access to an annulus defined around a tubing string extending into the wellbore. A mini-coil tubing string may be partially wound about a reel at the surface location and extending into the annulus through the primary annulus valve. The mini-coil tubing string may be constructed of a flexible material and configured to discharge an injection fluid from a distal end thereof. A pumping unit fluidly coupled to the mini-coil tubing string at the surface location may be operable to pump the injection fluid into the mini-coil tubing string. A guidance system may include a guide arch positioned within the primary annulus valve to facilitate transitioning the mini-coil tubing string between the surface location and the annulus in the wellbore without interrupting production through the tubing string.

According to another embodiment consistent with the present disclosure, a method for performing a cleanout operation in a wellbore may include (a) installing a guidance assembly within a primary annulus valve of a wellhead positioned over the wellbore, the guidance assembly arranged to facilitate a smooth transition of a mini-coil tubing string into and out of an annulus defined around a tubing string in the wellbore, (b) advancing a distal end of the mini-coil tubing string through the primary annulus valve and over the guidance assembly into the annulus, (c) operating a pumping unit fluidly coupled to the mini-coil tubing string to inject an injection fluid through the mini-coil tubing string and (d) discharging the injection fluid from the distal end of the mini-coil tubing string into the annulus so as to displace a contaminated fluid from the annulus.

According to still another embodiment consistent with the present disclosure, a wellhead assembly for conducting cleanout operations in a wellbore may include a tubing valve operable to selectively provide access to a tubing string extending from the wellhead assembly and a primary annulus valve operable to selectively provide access to an annulus around the tubing string. A guidance system may include a guide arch positioned within the primary annulus valve to facilitate transitioning a mini-coil tubing string into and out of the annulus.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
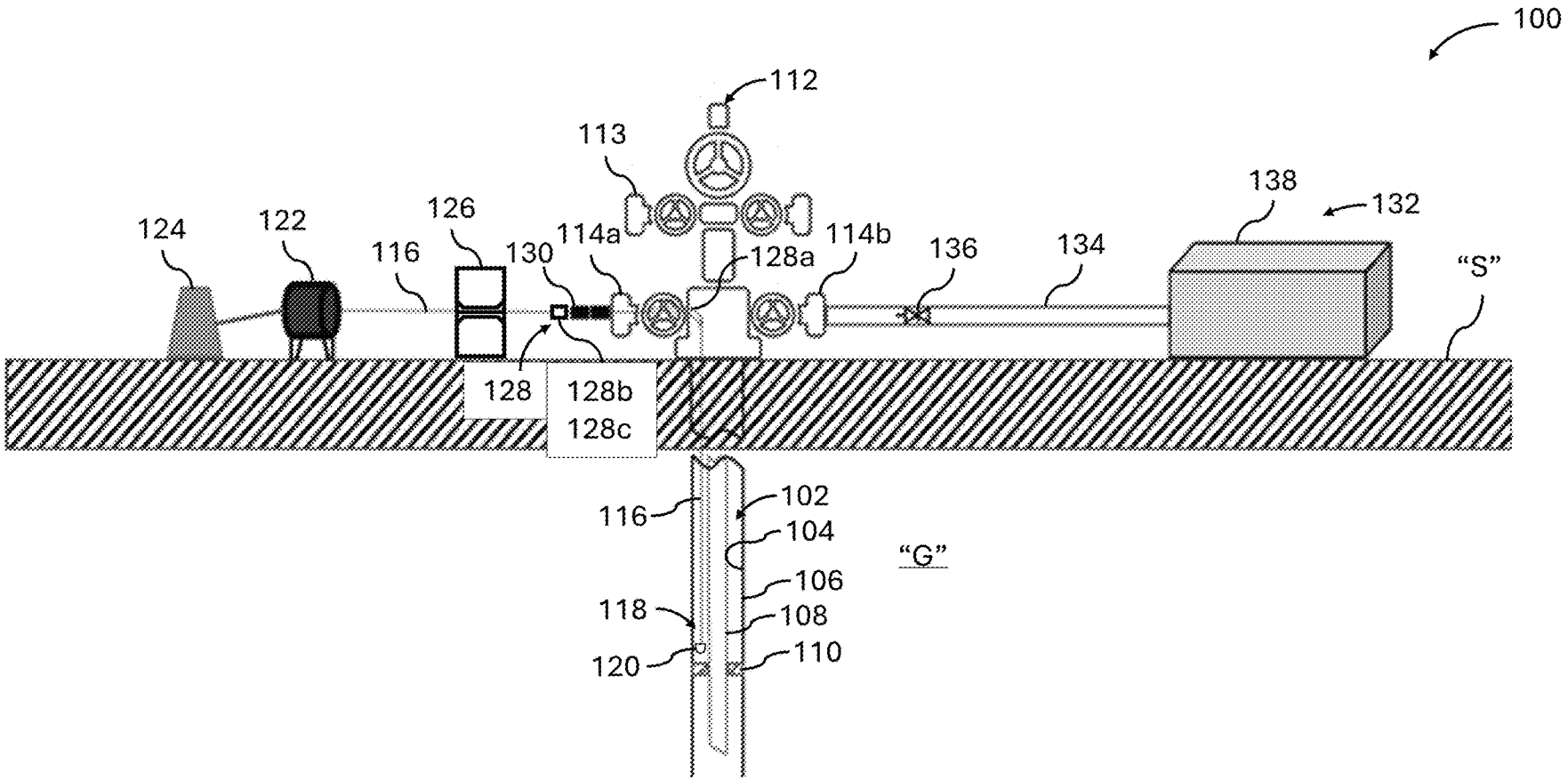
FIG. 1 is a schematic illustration of a wellbore tubing-casing annulus cleanout system in accordance with at least one aspect of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

According to aspects of the present disclosure, a system and method for pumping fluids into a tubing-casing annulus (TCA) of an oil gas wellbore are described. These systems and methods may facilitate operations such as annulus cleaning, packer repairs and annulus pumping. The systems may generally include a high elasticity mini-coil extended into the TCA defined between a tubing string and a casing string. The mini-coil may include a rounded head such that the mini-coil may be passed through stuffing boxes and over a guidance system at an annulus valve of a wellhead or wellbore surface equipment. The mini-coil may be constructed of a flexible carbon steel. A pumping unit may inject fluids into the TCA through the mini-coil and down against the packer. If returns are expected, a flowback passage may be coupled to a secondary annulus valve. A check valve in the flowback passage may ensure fluids flow in the direction of a tank and away from the wellbore.

FIG. 1 illustrates a surface intervention system 100 for pumping fluids into a tubing-casing annulus (TCA) 102 defined in an oil gas wellbore 104 in accordance with example embodiments of the present disclosure. The wellbore 104 extending from a surface location "S" and traversing a geologic formation "G." In the illustrated example, the wellbore 104 is substantially vertical. In other embodiments, aspects of the disclosure may be practiced in a wide variety of vertical, directional, deviated, slanted and/or horizontal portions therein, and may extend along any trajectory through the geologic formation "G."

As illustrated in FIG. 1, the wellbore 104 is lined with a casing string 106. The casing string 106 may be constructed from a series of high strength steel pipes or tubular sections that are joined together and lowered into the wellbore 104. The casing string 106 may be cemented in place to provide structural integrity to the wellbore 104 and to prevent the wellbore 104 from collapsing under the pressure of the surrounding geologic formation "G". A tubing string 108 extends into the wellbore 104 within the casing string 106. Similar to the casing string 106, the tubing string 108 may be constructed of a series of high strength steel pipes or tubular sections that are joined together and lowered into the wellbore 104. The tubing string 108, however, generally has a smaller diameter than the casing string 106, typically ranging from 2 inches to 4.5 inches, depending on the design and production requirements of the wellbore 104. The TCA 102 is generally defined in the radial space between the tubing string 108 and the casing string 106.

A packer 110 is installed in the TCA 102. The packer 110 may be constructed of high-performance elastomers such as nitrile rubber, fluoroelastomers such as Viton or ethylene propylene diene monomer (EPDM). These materials may be selected for their resistance to heat, chemicals and wear and may allow the packer 110 to expand and create a tight seal between the casing string 106 and the tubing string 108. The packer 110 may prevent unwanted fluid migration and protect other downhole equipment.

The production casing string 106 and the tubing string 108 may be supported by a wellhead 112 at the surface location "S". The wellhead 112 generally provides pressure containment and flow control for the wellbore 104 and serves as the connection point between the wellbore 104 and the surface equipment, ensuring safe and efficient operations during drilling, production, and intervention activities. The wellhead 112 may include at least one tubing valve 113 operable to selectively provide fluid communication between the surface location "S" and an interior of the tubing string 108. The wellhead 112 also includes a primary annulus valve 114*a* and a secondary annulus valve 114*b* (sometimes described as a "kill" valve). In some embodiments, the annulus valves 114*a*, 114*b* include gate valves providing a basic open and closed states for controlling access to the TCA 102. In other embodiments, the annulus valves 114*a*, 114*b* may include safety valves operable to close automatically in the event of a pressure drop or other emergency to prevent uncontrolled flow.

The surface intervention system 100 also includes a mini-coil tubing string 116 extending from the surface location "S" and into the TCA 102 through the primary annulus valve 114*a*. In some embodiments, the mini-coil tubing string 116 may have an outer diameter of 1 inch or less and may be constructed of metal-based materials (e.g., carbon steel) with high elasticity to ensure flexibility during operation. In some embodiments, a corrosion resistant alloy (CRA), such as stainless steel, nickel alloys and titanium, may be used to construct the mini-coil tubing string 116 for wellbores when $H_2S$ or other corrosive fluids may be encountered. A distal end 118 of the mini-coil tubing string 116 includes a rounded head 120. The rounded head 120 may include a rounded profile and may be constructed of a soft material such as copper, brass or bronze such that any impact occurring between the rounded head 120 and wellbore equipment while the mini-coil tubing is run into the wellbore 104 will result in limited damage. In some embodiments, the rounded head 120 may include one or more flow ports (not shown) therein through which fluids may be discharged into the TCA 102. In other embodiments, the flow ports may be provided in the mini-coil tubing string 116 above (uphole) of the rounded head 120.

At the surface location "S" the mini-coil tubing string 116 extends to a reel 122 and a pumping unit 124. The mini-coil tubing string 116 may be wound around the reel 122 to facilitate storage and transport of the mini-coil tubing string 116. The reel 122 may be hydraulically powered and controlled to wind and unwind the mini-coil tubing string 116 as the mini-coil tubing string 116 is raised and lowered within the TCA 102. The reel 122 may also include a manifold for receiving injection fluids from the pumping unit 124. The pumping unit 124 is fluidly coupled to the reel 122 and is operable to supply injection fluids to the reel 122 at a predetermined pressure. The injection fluids may pass through the mini-coiled tubing string 116 that is coiled on the reel 122 and then through the mini-coiled tubing string 116 extended into the TCA 102 through the primary annulus valve 114*a*. The pumping unit may include any suitable pump to convey liquid or gas injection fluids through the mini-coiled tubing string 116.

The mini-coil tubing string 116 may pass through an injector 126. The injector 126 is operable to grip the mini-coil tubing string 116 and provide the forces necessary for deployment and retrieval of the mini-coil tubing string 116. The mini-coil tubing string 116 may pass over a guidance system 128 to facilitate transitioning the mini-coil tubing string 116 between the surface location "S" and the TCA 102 of the wellbore 104. The guidance system 128 may include a guide arch 128*a*, roller guides 128*b* and an alignment system 128*c*. The guide arch 128*a* may extend into the primary annulus valve 114*a* and may be operable for guiding the mini-coil tubing string 116 through a predetermined curvature. The roller guides 128*b*, also known as "roller bogie guides," may be operable to support and guide the mini-coil tubing string 116 downhole, reducing friction, and minimizing breakage to the mini-coil tubing string 116, and the alignment system 128*c* may be operable to monitor and correct any deviations or bends in the mini-coil tubing string 116 to help ensure the mini-coil tubing string 116 remains straight and aligned within the TCA 102 of the wellbore 104. The roller guides 128*b* and the alignment system 128*c* may be located upstream of a pair of stuffing boxes 130 (described in greater detail below), for example between the pair of stuffing boxes 130 and the injector 126. In other embodiments, one or both of the roller guides 128*b* and alignment system 128*c* may be incorporated into the stuffing boxes 130.

The stuffing boxes 130 may include at least two stuffing boxes 130 coupled to an exterior of the primary annulus valve 114*a* to provide well control while the mini-coil tubing string 116 is deployed in the wellbore 104. The stuffing boxes 130 may include sealed chambers with packing materials therein to prevent leakage around the mini-coil tubing string 116 extending therethrough. The stuffing boxes 130 may prevent loss of the injection fluids, maintain pressure in the TCA 102, and ensure the safety of wellbore operators at the surface location "S."

In some embodiments, where fluid returns (e.g., a contaminated fluid from the TCA 102) are anticipated during a cleanout operation, a flowback assembly 132 may be fluidly coupled to the secondary annulus valve 114*b*. The flowback assembly 132 includes a flowback line 134 with a check valve 136 arranged therein to ensure one-way flow away from the wellbore 104. The flowback line 134 extends to a storage tank 138 that is operable to contain the expected fluid returns from the TCA 102.

Figure 2:
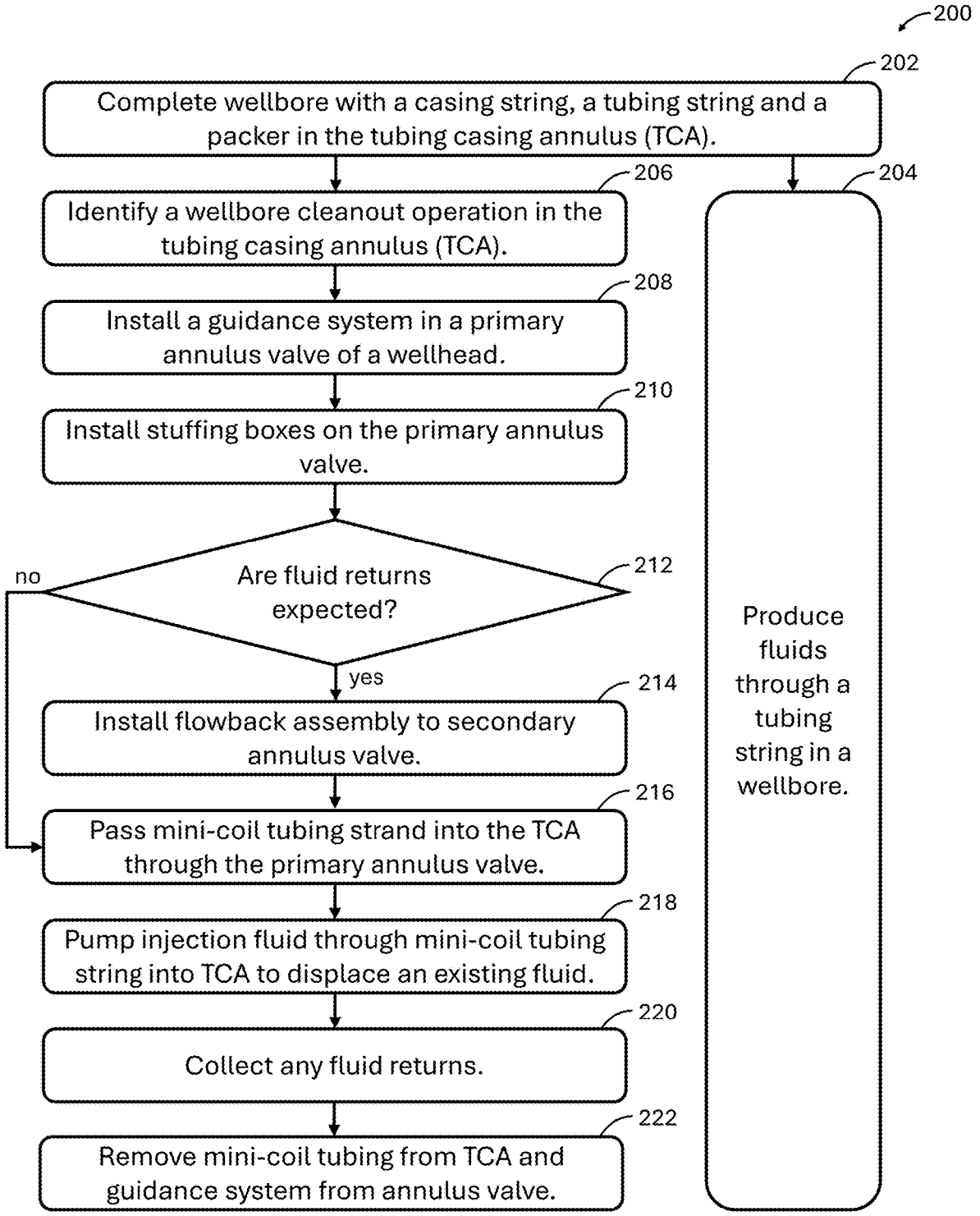
FIG. 2 is a flowchart illustrating the procedure for cleaning out a tubing-casing annulus in a wellbore according to at least one aspect of the present disclosure.

Referring now to FIG. 2, an example method or procedure 200 for conducting a cleanout operation in a wellbore is described. Aspects of the procedure 200 may be implemented or conducted with components of the surface intervention system 100 of FIG. 1, and accordingly, reference is made to FIG. 1 in describing the procedure 200.

Initially at step 202, a wellbore 104 may be completed by installing a casing string 106, a tubing string 108 and a packer 110 in the TCA 102. The procedure 200 may then proceed to step 204 where fluids may be produced through the tubing string 108. For example, oil, gas and other hydrocarbons trapped in the geologic formation may be brought to the surface location "S" through the tubing string 108.

Next, while fluids are being produced through the tubing string 108, the procedure 200 may proceed to step 206, where a cleanout operation in the TCA 102 is identified. The need for a cleanout operation may be identified by direct methods such as detecting a pressure change indicative of potential damage to the packer 110, the tubing string 108 or the casing string 106, inspecting a fluid sample from the TCA 102 for the presence of contaminated fluids, or simply detecting an unexpected reduction in the amount of production fluids being produced to the surface location "S."

Next, at step 208 the guidance system 128 may be installed in the primary annulus valve 114*a*. The primary annulus valve 114*a* may be opened and the guide arch 128*a*, may be inserted therein and secured in place. The roller guides 128*b*, alignment system 128*c* and/or stuffing boxes 130 may also be installed onto the into the primary annulus valve 114*a* at step 210.

At decision 212, it is determined whether or not fluid returns are anticipated from the cleanout operation. For example, if it is expected that pumping an injection fluid into TCA 102 will displace the fluid existing in the TCA 102 (e.g., a contaminated or unwanted fluid) into the geologic formation "G" or into other portions of the wellbore 104, then no fluid returns may be expected, and the procedure 200 may transition to step 216. If it is expected that pumping the injection fluid into TCA 102 will displace the fluid existing in the TCA 102 to the surface location "S," then fluid returns may be anticipated. Where fluid returns are expected, the procedure 200 may proceed to step 214 where the flowback assembly 132 is installed. The flowback line 134 may be fluidly coupled between the secondary annulus valve 114*b* and the storage tank 138. Where no fluid returns are expected, the procedure 200 may skip step 214 and proceed directly to step 216.

At step 216, the mini-coil tubing string 116 may be passed through the stuffing boxes 130 and primary annulus valve 114*a* into the TCA 102. The mini-coil tubing string 116 may pass through the wellhead 112 and over the guidance system 128 without damaging any surface equipment since the rounded head 120 is constructed from a soft material with a rounded profile. The mini-coil tubing string 116 may be unwound from the reel 122 and advanced to a predetermined depth within the TCA 102 with the injector 126. The stuffing boxes 130 may maintain well control while the mini-coil tubing string 116 extends through the primary annulus valve 114*a*.

The procedure 200 may then proceed to step 218 where the pumping unit 124 may be operated to pump injection fluids through the mini-coil tubing string 116. The injection fluids may be discharged from the rounded head 120 or from elsewhere on the mini-coil tubing string 116 into the TCA 102 to perform the cleanout operation.

At step 220, any fluids displaced by the injection fluids out of the TCA 102 may pass through the secondary annulus valve 114*b* into the flowback line 134 (if installed at step 214) and into the storage tank 138. The fluid returns collected in the storage tank 138 may include any contaminated fluid and debris from the TCA 102.

Once the contaminated fluid has been collected and the TCA 102 is filled with the injection fluid, the procedure 200 may proceed to step 222. The mini-coil tubing string 116 may be run out of the wellbore 104 with the injector 126 and may be returned to the reel 122. The guidance system 128 may be removed from the interior and exterior of primary annulus valve 114*a* and the flowback assembly 132 may be disconnected from the secondary annulus valve 114*b* to complete the procedure. At least since access to the tubing string 108 is not required, the cleanout steps of the procedure 200 may be performed without interrupting production of a production fluid through the tubing string 108. For example, steps 206-222 may be performed simultaneously and concurrently with step 204.

Embodiments disclosed herein include:

A. A system for performing cleanout operations in a wellbore can include a wellhead positioned at surface location over the wellbore and include a primary annulus valve for providing selective access to an annulus defined around a tubing string extending into the wellbore. A mini-coil tubing string can be partially wound about a reel at the surface location and extending into the annulus through the primary annulus valve. The mini-coil tubing string can be constructed of a flexible material and configured to discharge an injection fluid from a distal end thereof. A pumping unit fluidly coupled to the mini-coil tubing string at the surface location can be operable to pump the injection fluid into the mini-coil tubing string. A guidance system can include a guide arch positioned within the primary annulus valve to facilitate transitioning the mini-coil tubing string between the surface location and the annulus in the wellbore without interrupting production through the tubing string.

B. A method for performing a cleanout operation in a wellbore can include the steps of (a) installing a guidance assembly within a primary annulus valve of a wellhead positioned over the wellbore, the guidance assembly arranged to facilitate a smooth transition of a mini-coil tubing string into and out of an annulus defined around a tubing string in the wellbore, (b) advancing a distal end of the mini-coil tubing string through the primary annulus valve and over the guidance assembly into the annulus, (c) operating a pumping unit fluidly coupled to the mini-coil tubing string to inject an injection fluid through the mini-coil tubing string and (d) discharging the injection fluid from the distal end of the mini-coil tubing string into the annulus so as to displace a contaminated fluid from the annulus.

C. A wellhead assembly for conducting cleanout operations in a wellbore can include a tubing valve operable to selectively provide access to a tubing string extending from the wellhead assembly and a primary annulus valve operable to selectively provide access to an annulus around the tubing string. A guidance system can include a guide arch positioned within the primary annulus valve to facilitate transitioning a mini-coil tubing string into and out of the annulus.

Each of embodiments A, B, and C may have one or more of the following additional elements in any combination: Element 1: wherein the annulus includes a tubing casing annulus (TCA) defined between the tubing string and a casing string in the wellbore. Element 2: further comprising a packer extending across the TCA below the distal end of the mini-coil tubing string and forming a seal with the tubing string and the casing string. Element 3: wherein the distal end of the mini-coil tubing string includes a rounded head having a rounded profile and fabricated by a soft metal including at least one of brass, bronze and titanium. Element 4: further comprising a pair of stuffing boxes coupled to an exterior of the at least one primary valve, wherein the mini-coil tubing strand extends through the pair of stuffing boxes. Element 5: further comprising an injector at the surface location and operable to grip the mini-coil tubing string and impart forces to the mini-coil tubing string for deployment and retrieval of mini-coil tubing string from the annulus. Element 6: further comprising a flowback assembly fluidly coupled to a secondary annulus valve providing selective access to the annulus and operable to receive fluid returns from the annulus. Element 7: wherein the flowback assembly includes a flowback line extending from the secondary annulus valve to a storage tank operable to contain the fluid returns from the annulus.

Element 8: further comprising producing a production fluid through the tubing string concurrently with installing the guidance assembly, advancing the distal end of the mini-coil tubing string, operating the pumping unit and discharging the injection fluid. Element 9: further comprising installing a pair of stuffing boxes on an exterior of the primary annulus valve, passing the distal end of the mini-coil tubing string through the pair of stuffing boxes and maintaining well control during the cleanout operation by sealingly engaging the mini-coil tubing string with the stuffing boxes. Element 10: wherein passing the distal end of the mini-coil tubing string through the pair of stuffing boxes and advancing the distal end through the primary annulus valve comprises gripping the mini-coil tubing string with an injector and imparting forces to mini-coil tubing string to advance the mini-coil tubing string through the injector. Element 11: further comprising unwinding the mini-coil tubing from a reel in response to advancing the mini-coil tubing string through the injector. Element 12: further comprising fluidly coupling a flowback assembly to a secondary annulus valve of the wellhead and receiving the contaminated into the flowback assembly in response to displacing the contaminated fluid from the annulus. Element 13: further comprising collecting the contaminated fluid in a storage tank of the flowback assembly. Element 14: further comprising removing the distal end of the mini-coil tubing string from the annulus and removing the guidance system from the annulus valve subsequent to discharging the injection fluid. Element 15: further comprising identifying the cleanout operation by detecting a reduction in the amount of production fluids being produced to the surface location.

Element 16: further comprising a pair of stuffing boxes coupled to an exterior of the primary annulus valve, the pair of stuffing boxes operable to sealingly engage the mini-coil tubing string. Element 17: further comprising a secondary annulus valve operable to selectively provide access to the annulus and to which a flowback assembly may be coupled to receive fluid returns from the annulus.

By way of non-limiting example, exemplary combinations applicable to A, B, and C include: Element 1 with Element 2; Element 6 with Element 7; Element 9 with Element 10; Element 10 with Element 11 and Element 12 with Element 13.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system for performing cleanout operations in a wellbore, the system comprising:

a wellhead positioned at a surface location over the wellbore and including a primary annulus valve for providing selective access to an annulus defined around a tubing string extending into the wellbore;

a mini-coil tubing string partially wound about a reel at the surface location and extending into the annulus through the primary annulus valve, the mini-coil tubing string being constructed of a flexible material and configured to discharge an injection fluid from a distal end thereof;

a pumping unit fluidly coupled to the mini-coil tubing string at the surface location and operable to pump the injection fluid into the mini-coil tubing string; and a guidance system including a guide arch positioned within the primary annulus valve to facilitate transitioning the mini-coil tubing string between the surface location and the annulus in the wellbore without interrupting production through the tubing string, wherein the distal end of the mini-coil tubing string includes a rounded head sized and configured to pass through the primary annulus valve without interrupting production through the tubing string, and wherein the guide arch is configured to be removably installed within the primary annulus valve during a cleanout operation and removed from the primary annulus valve upon completion of the cleanout operation without interrupting production through the tubing string.

2. The system of claim 1, wherein the annulus includes a tubing casing annulus (TCA) defined between the tubing string and a casing string positioned in the wellbore.

3. The system of claim 2, further comprising a packer extending across the TCA below the distal end of the mini-coil tubing string and forming a seal with the tubing string and the casing string.

4. The system of claim 1, wherein the rounded head is fabricated of a soft metal including at least one of brass, bronze and titanium.

5. The system of claim 1, further comprising at least one stuffing box coupled to an exterior of the at least one primary valve, wherein the mini-coil tubing strand extends through the at least one stuffing box.

6. The system of claim 1, further comprising an injector at the surface location and operable to advance or retract the mini-coil tubing string into or out of the annulus.

7. The system of claim 1, further comprising:

a secondary annulus valve forming part of the well head and providing selective access to the annulus; and a flowback assembly fluidly coupled to the secondary annulus valve and operable to receive fluid returns from the annulus.

8. The system of claim 7, wherein the flowback assembly includes a flowback line extending from the secondary annulus valve to a storage tank operable to contain the fluid returns from the annulus.

9. A method for performing a cleanout operation in a wellbore, comprising:

installing a guidance assembly within a primary annulus valve of a wellhead positioned over the wellbore, the guidance assembly arranged and operable to facilitate a smooth transition of a mini-coil tubing string into and out of an annulus defined around a tubing string in the wellbore;

advancing a distal end of the mini-coil tubing string through the primary annulus valve and over the guidance assembly into the annulus;

operating a pumping unit fluidly coupled to the mini-coil tubing string to inject an injection fluid through the mini-coil tubing string;

discharging the injection fluid from the distal end of the mini-coil tubing string and into the annulus, and thereby displacing a contaminated fluid from the annulus;

removing the distal end of the mini-coil tubing string from the annulus; and removing the guidance system from the annulus valve subsequent to discharging the injection fluid.

10. The method of claim 9, further comprising producing a production fluid through the tubing string concurrently with installing the guidance assembly, advancing the distal end of the mini-coil tubing string, and operating the pumping unit and discharging the injection fluid.

11. The method of claim 9, further comprising:

installing at least one stuffing box on an exterior of the primary annulus valve;

passing the distal end of the mini-coil tubing string through the at least one stuffing box; and maintaining well control during the cleanout operation by sealingly engaging the mini-coil tubing string with the at least one stuffing box.

12. The method of claim 11, wherein passing the distal end of the mini-coil tubing string through the at least one stuffing box and advancing the distal end through the primary annulus valve comprises gripping the mini-coil tubing string with an injector and imparting forces to the mini-coil tubing string to advance the mini-coil tubing string through the injector.

13. The method of claim 12, further comprising unwinding the mini-coil tubing string from a reel in response to advancing the mini-coil tubing string through the injector.

14. The method of claim 9, further comprising:

fluidly coupling a flowback assembly to a secondary annulus valve of the wellhead; and receiving the contaminated fluid into the flowback assembly in response to displacing the contaminated fluid from the annulus.

15. The method of claim 14, further comprising collecting the contaminated fluid in a storage tank of the flowback assembly.

16. The method of claim 9, further comprising identifying the cleanout operation by detecting a reduction in the amount of production fluids being produced to the surface location.

17. A wellhead assembly for conducting cleanout operations in a wellbore; the wellhead assembly comprising:

a tubing valve operable to selectively provide access to a tubing string extending from the wellhead assembly;

a primary annulus valve operable to selectively provide access to an annulus around the tubing string; and a guidance system including a guide arch positioned within the primary annulus valve to facilitate transitioning a mini-coil tubing string into and out of the annulus, wherein the guide arch is configured to be removably installed within the primary annulus valve during a cleanout operation and removed from the primary annulus valve upon completion of the cleanout operation without interrupting production through the tubing string.

18. The wellhead assembly of claim 17, further comprising a pair of stuffing boxes coupled to an exterior of the primary annulus valve, the pair of stuffing boxes operable to sealingly engage the mini-coil tubing string.

19. The wellhead assembly of claim 18, wherein the pair of stuffing boxes are operable to maintain well control during deployment and retrieval of the mini-coil tubing string through the primary annulus valve.

20. The wellhead assembly of claim 17, further comprising a secondary annulus valve operable to selectively provide access to the annulus and to which a flowback assembly may be coupled to receive fluid returns from the annulus.

* * * * *